US010822800B2

(12) United States Patent
Kraft

(10) Patent No.: US 10,822,800 B2
(45) Date of Patent: Nov. 3, 2020

(54) SHINGLE ASSEMBLY

(71) Applicant: Steven Charles Kraft, Moorhead, MN (US)

(72) Inventor: Steven Charles Kraft, Moorhead, MN (US)

( * ) Notice: Subject to any disclaimer, the term of this patent is extended or adjusted under 35 U.S.C. 154(b) by 0 days.

(21) Appl. No.: 16/185,057

(22) Filed: Nov. 9, 2018

(65) Prior Publication Data

US 2020/0149281 A1 May 14, 2020

(51) Int. Cl.

| | |
|---|---|
| ***E04D 1/26*** | (2006.01) |
| ***E04F 13/08*** | (2006.01) |
| ***E04F 13/18*** | (2006.01) |
| ***E04D 3/365*** | (2006.01) |

(52) U.S. Cl.

CPC ..... *E04D 1/265* (2013.01); *E04F 13/0864* (2013.01); *E04D 3/365* (2013.01); *E04F 13/18* (2013.01)

(58) Field of Classification Search

CPC ... E04D 13/0864; E04D 13/18; E04D 13/185; E04D 13/0869; E04D 13/0894; E04D 13/0889; E04D 3/365; E04D 3/362; E04D 3/363; E04D 3/0445; E04D 1/265

USPC ..... 52/518–523, 533–559

See application file for complete search history.

(56) References Cited

U.S. PATENT DOCUMENTS 3,579,940 A * 5/1971 Greenleaf ..... E04D 1/20 52/542
3,862,532 A * 1/1975 Markos ..... E04D 1/08 52/521
D256,954 S * 9/1980 Morita ..... D25/139
4,343,126 A 8/1982 Hoofe, III
4,423,572 A 1/1984 Tor
5,355,649 A 10/1994 Berridge
5,651,227 A * 7/1997 Anderson ..... E04F 13/0864 52/519
5,768,844 A * 6/1998 Grace, Sr. ..... E04D 3/32 52/529
5,956,913 A 9/1999 Nicholson
6,298,625 B1 10/2001 Sweet
6,370,832 B1 4/2002 McGarry
7,178,295 B2 2/2007 Dinwoodie
7,698,864 B2 * 4/2010 Justice ..... E04F 13/185 52/519
7,739,847 B2 * 6/2010 Griman ..... E04F 13/0864 52/478
8,590,270 B2 11/2013 Martinique
8,671,639 B2 3/2014 Stanger
D710,036 S * 7/2014 Wakebe ..... D25/141
9,267,289 B2 2/2016 Vander Laan
(Continued)

*Primary Examiner* — Basil S Katcheves
*Assistant Examiner* — Omar F Hijaz

(57) ABSTRACT

A shingle assembly includes a panel that has a front side, a back side, an upper edge, a lower edge, a first lateral edge, and a second lateral edge. An upper coupler is attached to and extends along the upper edge. A lower coupler is attached to and extends along the lower edge and snappily engages an upper coupler of another one of the shingle assemblies. A flange is integrally attached to and extends along the second lateral edge such that the flange and the panel form a unitary member. The flange extends laterally away from the panel. A lip is coextensive with and extends forwardly of an upper edge of the flange and inhibits water from wicking upwardly beyond the upper edge of the flange.

7 Claims, 14 Drawing Sheets

(56) References Cited

U.S. PATENT DOCUMENTS

| | | | | |
|---|---|---|---|---|
| 9,356,174 | B2 | 5/2016 | Duarte | |
| D814,067 | S * | 3/2018 | De Giorgi | D25/139 |
| 2006/0130419 | A1 | 6/2006 | Bowman | |
| 2015/0089885 | A1* | 4/2015 | Wakebe | E04D 1/18 52/105 |
| 2016/0222667 | A1* | 8/2016 | Anderson | E04D 1/30 |

* cited by examiner

SHINGLE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to roofing materials and more particularly pertains to a new roofing tile for positioning on a roof to function as shingling and to prevent the wicking of water thereunder. Prior art devices have suffered from an inability to prevent water from being driven around upper and lateral edges of tiles, particularly metal tiles, such that water wicks between and around tiles to damage the substructure of the roofing. The present invention tiles prevent water from movement around the sides and upper edges while generally directing the water downward and off of a roof.

BRIEF SUMMARY OF THE INVENTION

An embodiment of the disclosure meets the needs presented above by generally comprising a shingle assembly including panel that has a front side, a back side, an upper edge, a lower edge, a first lateral edge, and a second lateral edge. An upper coupler is attached to and extends along the upper edge. A lower coupler is attached to and extends along the lower edge. The lower coupler is configured to snappily engage an upper coupler of another one of the shingle assemblies. A flange is integrally attached to and extends along the second lateral edge such that the flange and the panel form a unitary member. The flange extends laterally away from the panel and has a front side, a back side, an upper edge, and a lower edge corresponding to the front and back sides and the upper and lower edges of the panel. The flange has a distal edge with respect to the panel. A lip is coextensive with and extends forwardly of the upper edge of the flange. The lip inhibits water from wicking upwardly beyond the upper edge of the flange.

Another embodiment of the disclosure meets the needs presented above by generally comprising a shingle assembly including a panel that has a front side, a back side, an upper edge, a lower edge, a first lateral edge, and a second lateral edge. An upper coupler is attached to and extends along the upper edge. A lower coupler is attached to and extends along the lower edge. The lower coupler is configured to engage an upper coupler of another one of the shingle assemblies. A flange is integrally attached to and extends along the second lateral edge such that the flange and the panel form a unitary member. The flange extends laterally away from the panel and has a front side, a back side, an upper edge, and a lower edge corresponding to the front and back sides and the upper and lower edges of the panel. The flange has a distal edge with respect to the panel. A channel extends into the front side of the flange and is configured to direct water away from the upper edge and toward the lower edge.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
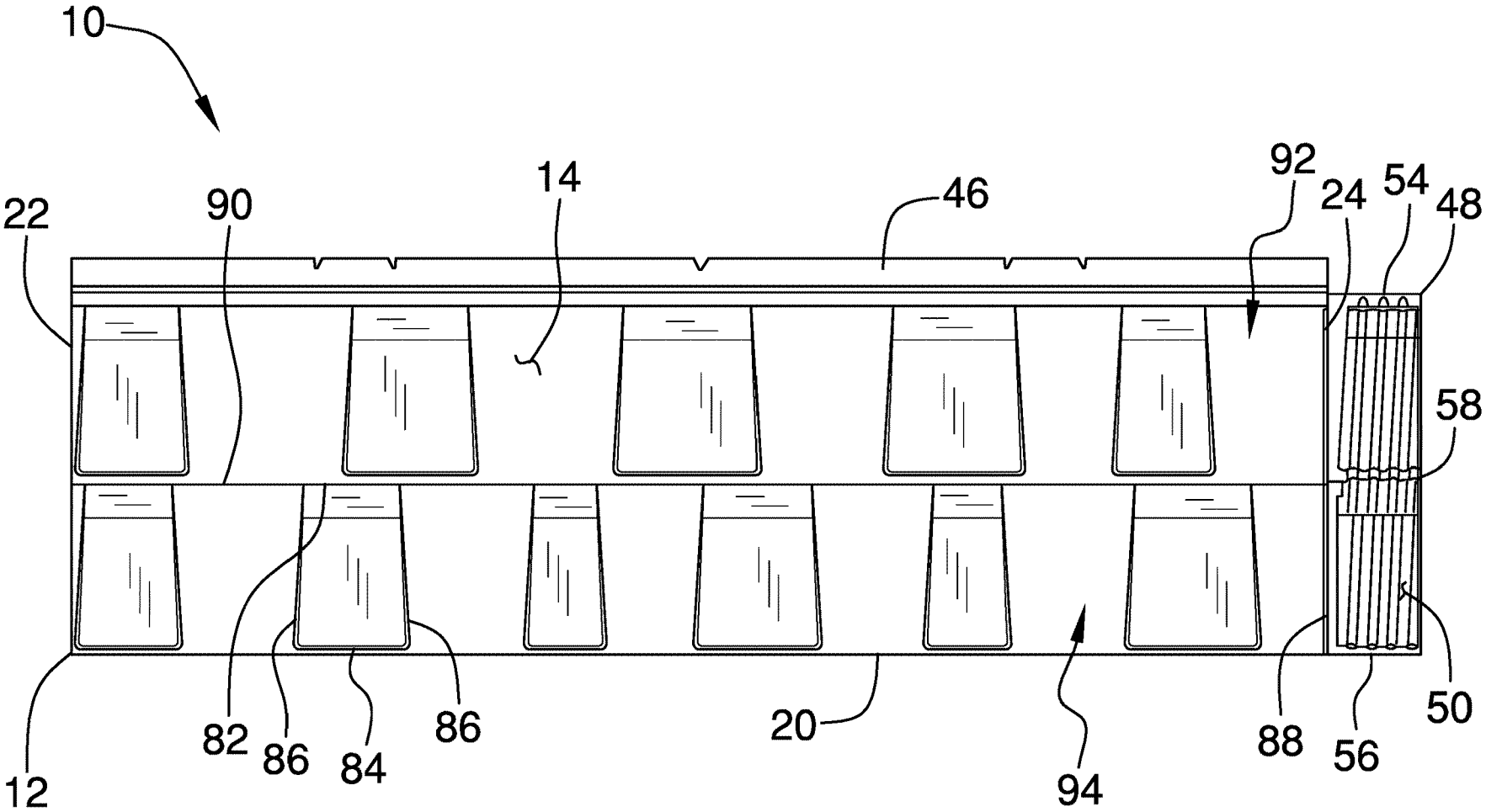
FIG. 1 is a front view of a shingle assembly according to an embodiment of the disclosure.
Figure 2:
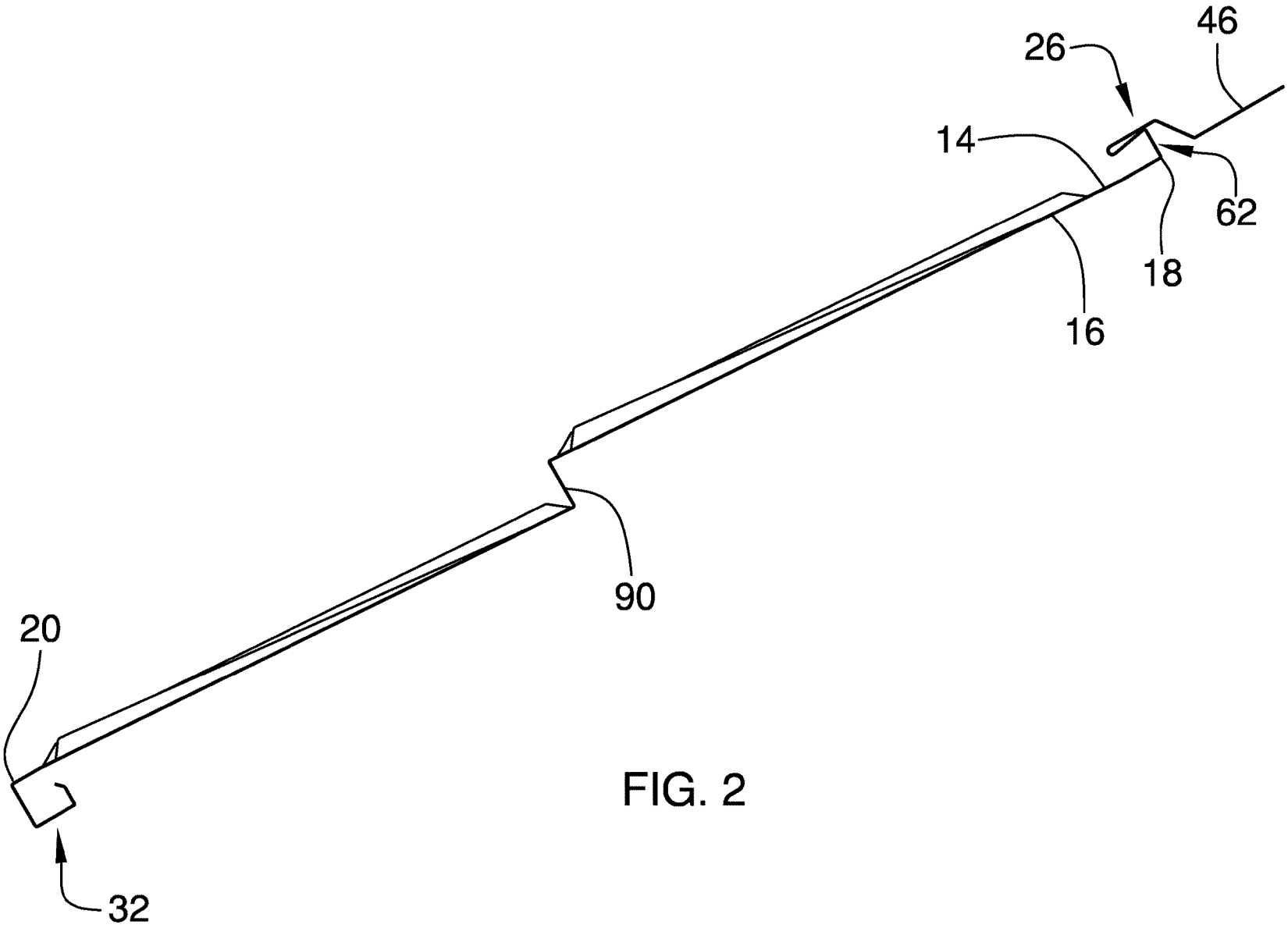
FIG. 2 is a side view of an embodiment of the disclosure.

With reference now to the drawings, and in particular to FIGS. 1 through 14 thereof, a new roofing tile embodying the principles and concepts of an embodiment of the disclosure and generally designated by the reference numeral 10 will be described.

As best illustrated in FIGS. 1 through 14, the shingle assembly 10 generally comprises a unitary structure of material formed into the elements stated herein. Also, the term "shingle" herein is being used to generally describe a roofing and substructure protection assembly positioned on a substructure to protect the substructure from the elements. As such, it should be understood that the shingle assembly 10 may be used for roof shingling and wall siding purposes. The shingle assembly 10 including a panel 12 that has a front side 14, a back side 16, an upper edge 18, a lower edge 20, a first lateral edge 22, and a second lateral edge 24 as shown best in FIGS. 1, 2 and 5. It should be understood that the terms front, back, upper and lower are for ease of reference alone as the assembly 10 will typically be angled rearwardly from the lower edge 20 to the upper edge 18. This angle will match the roof substructure at will be what is known as a "steep slope" with a pitch of at 3:12 (at least 14° with respect to a horizontal) but may be vertically orientated if the assembly 10 is utilized as wall siding. The panel 12 will normally be comprised of a resiliently bendable material conventional to roofing materials, though any suitable roofing material may be used such as plastics, metals, metallic alloys and the like. Some particular materials used for such purposes include aluminum-zinc alloy coated sheet steel, aluminum, galvanized steel and aluminum. Coatings may or may not be placed on the assembly 10 and may include, for example, stone coating, paints.

An upper coupler 26 is attached to and extends along the upper edge 18. The upper coupler 26 includes a forward portion 28 abutting and extending forwardly from the upper edge 18 and a downward portion 30 extending from the forward portion 28 and over the front side 14. The downward portion 30 is angled rearwardly toward the front side 14. As can be seen best in FIG. 6, in an embodiment of the invention, the forward portion 28 may be planar orientated approximately perpendicular to the front side 14 while the downward portion 30 is also planar and forms an acute angle with the forward portion 28. However, it should be understood the forward 28 and downward 30 portions of upper coupler 26 may be arcuate or include arcuate sections such that the upper coupler 26 is generally C-shaped to form a receiving space.

A lower coupler 32 is attached to and extends along the lower edge 20. The lower coupler 32 is configured to snappily engage an upper coupler 26 of another one of the shingle assemblies 10 when the shingle assemblies 10 are engaged vertically with respect to each other. The upper coupler 26 may comprise a female coupler while the lower coupler 32 would then comprise a male coupler. The lower coupler 32 includes a rearward section 34 abutting and extending rearwardly from the lower edge 20. An extension portion 36 is attached to the rearward section 34 and extends upwardly and then forwardly with respect to the panel 12. The extension portion 36 has a terminal end 38 that spaced from the back side 16 of the panel 12 a distance greater than a distance between an outer end 40 of the downward portion 30 and the front side 14 of the panel 12. Thus, the extension portion 36 must engage, be forced under and snap into a space between the outer end 40 and forward portion 28.

Figure 7:
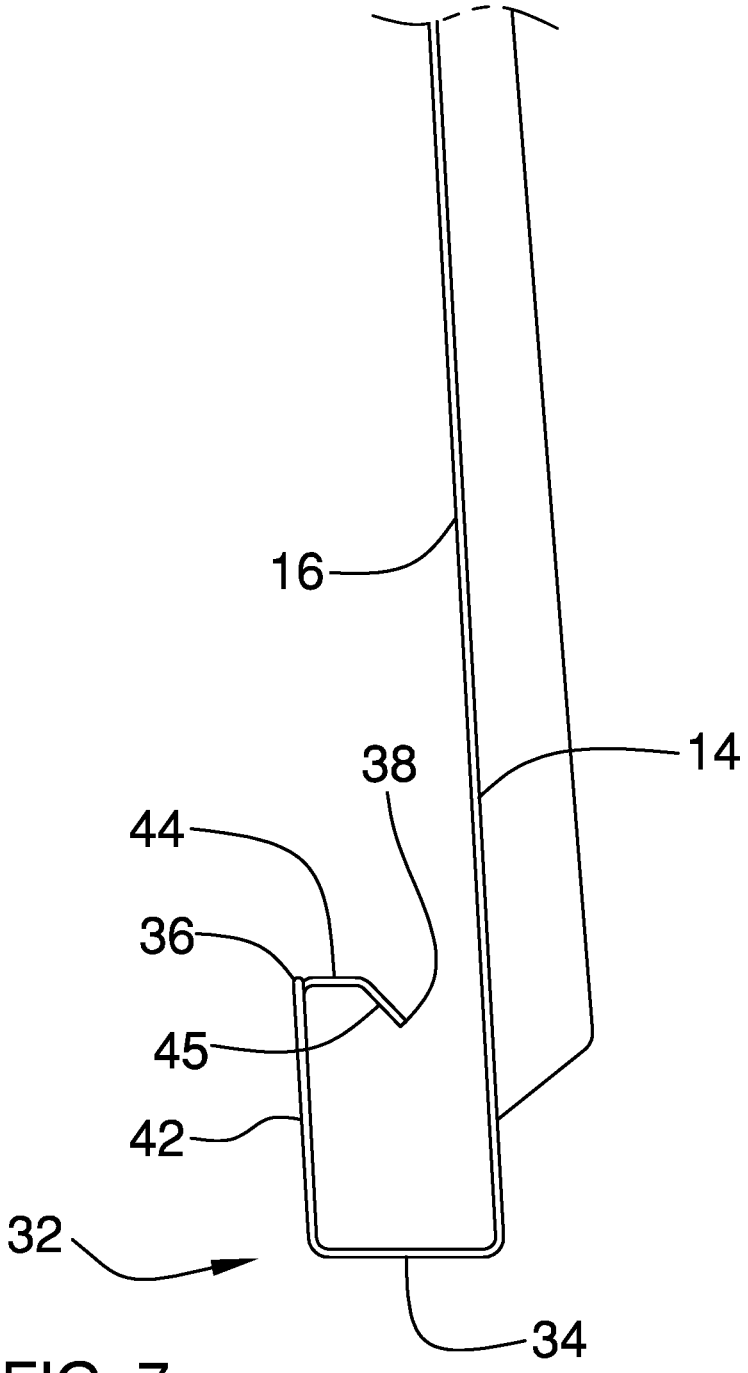
FIG. 7 is a broken side view of a lower coupler of an embodiment of the disclosure.
Figure 8:
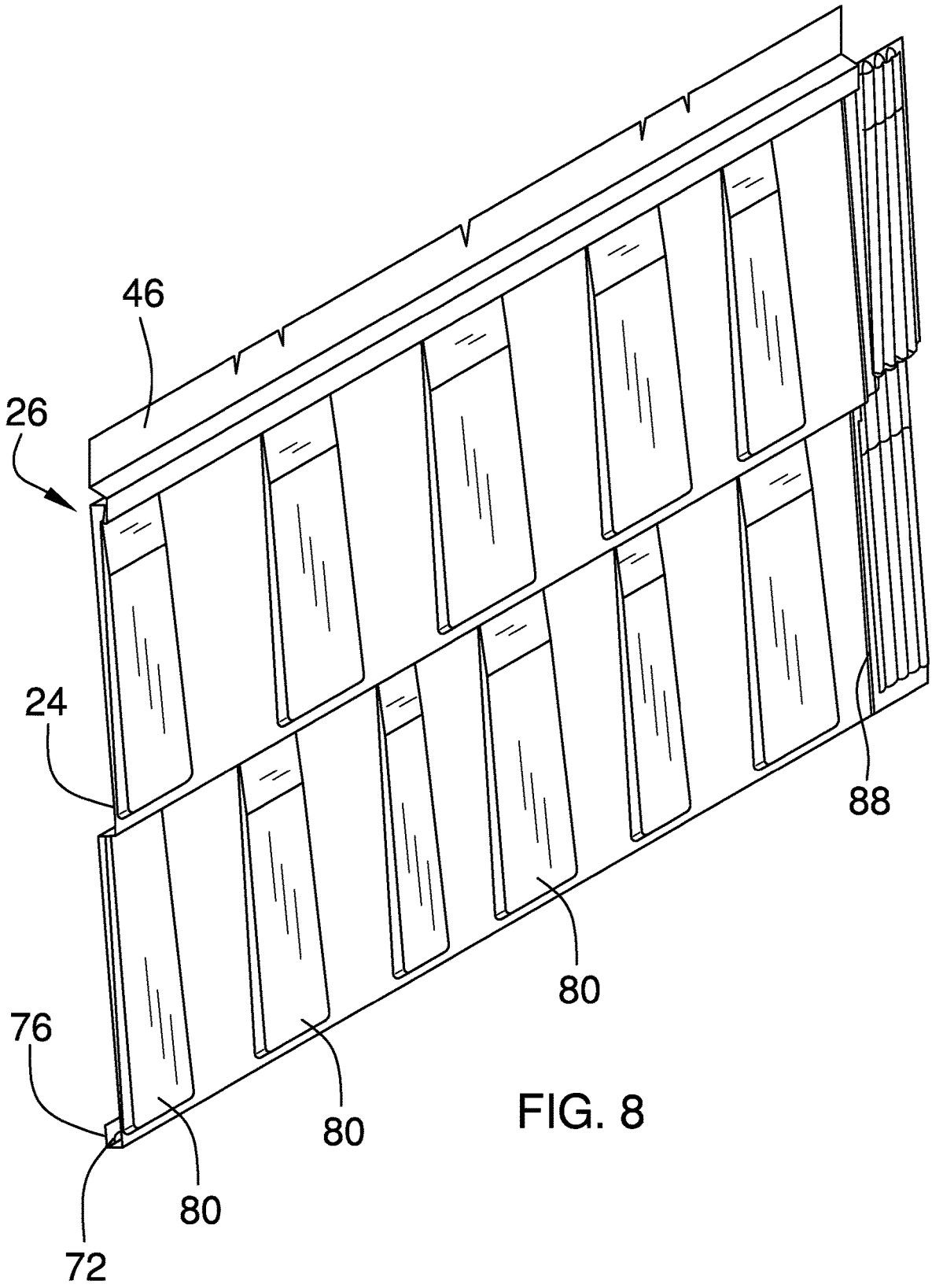
FIG. 8 is a front left isometric view of an embodiment of the disclosure.
Figure 9:
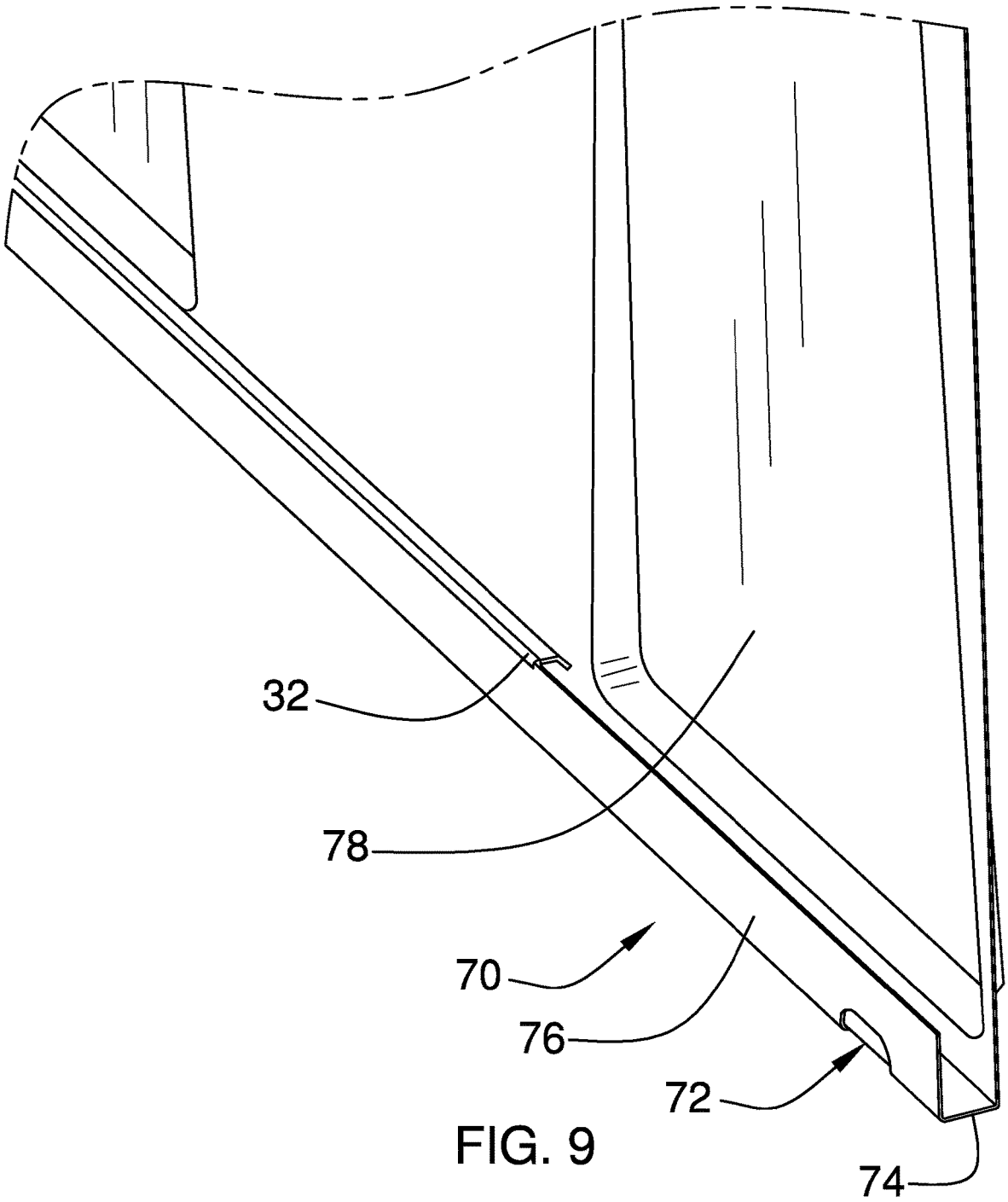
FIG. 9 is a rear, left top isometric view of an embodiment of the disclosure showing a detail of a receiver thereof.
Figure 10:
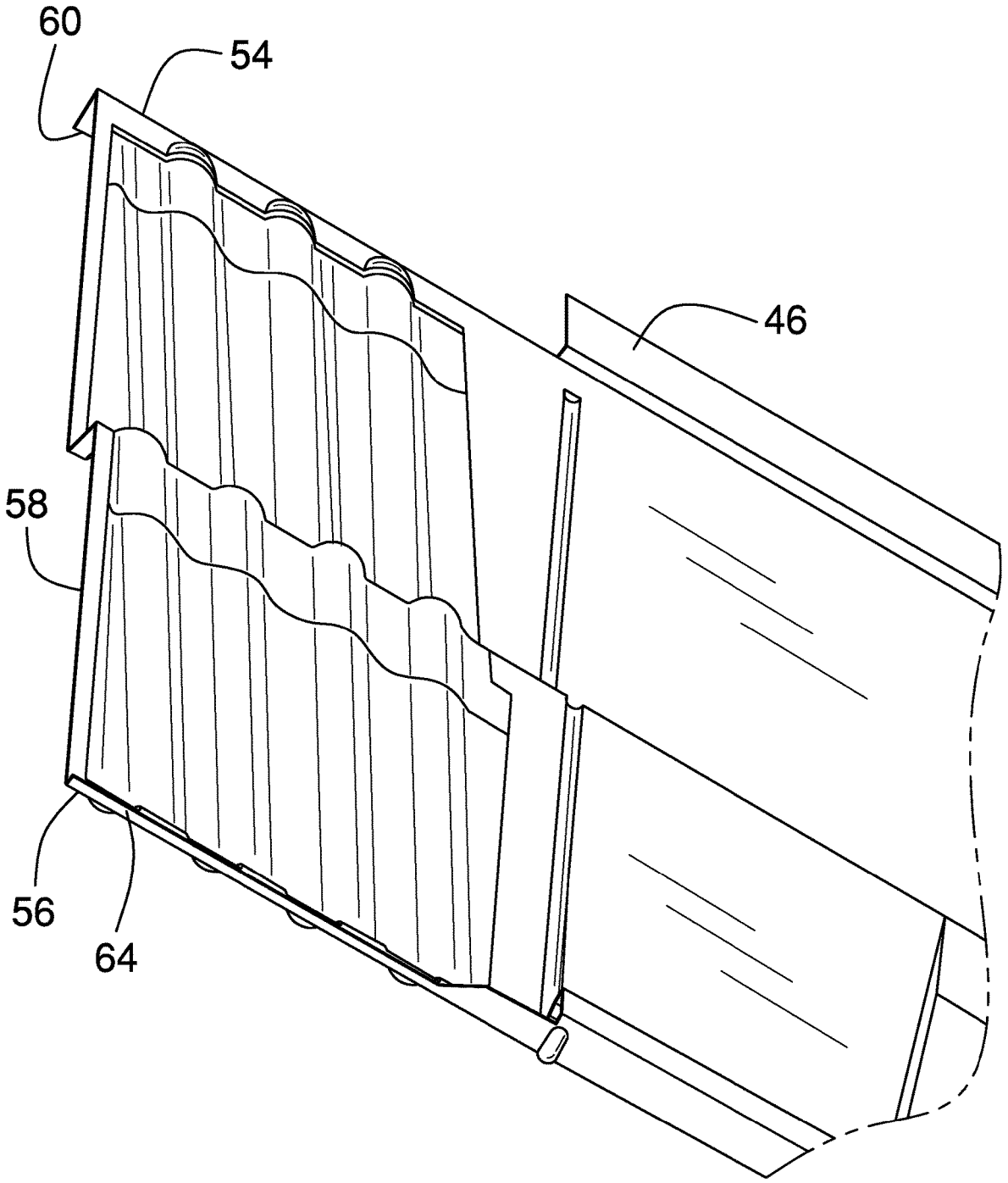
FIG. 10 is a rear, bottom right isometric view of an embodiment of the disclosure.
Figure 11:
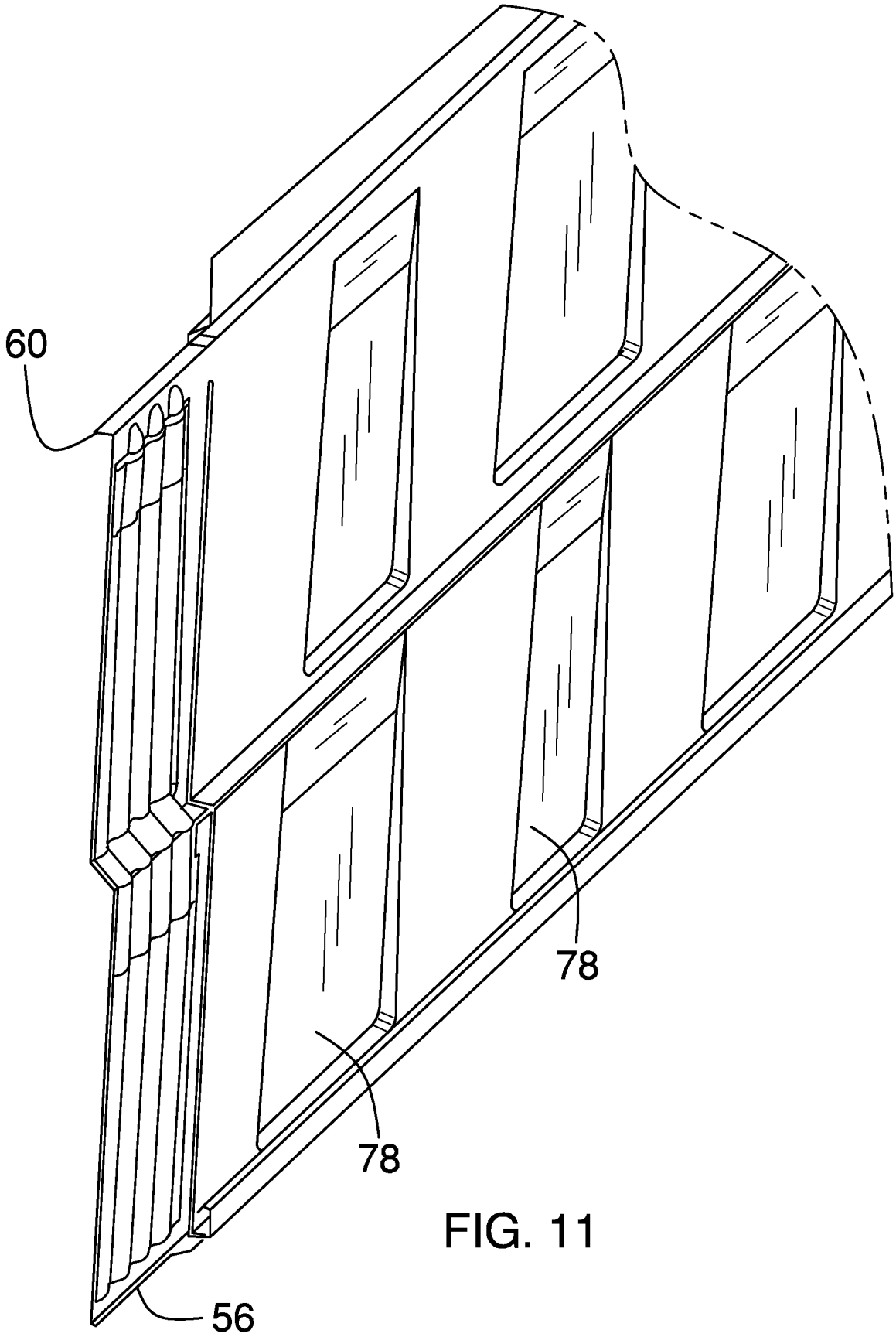
FIG. 11 is a rear, top right isometric view of an embodiment of the disclosure.
Figure 12:
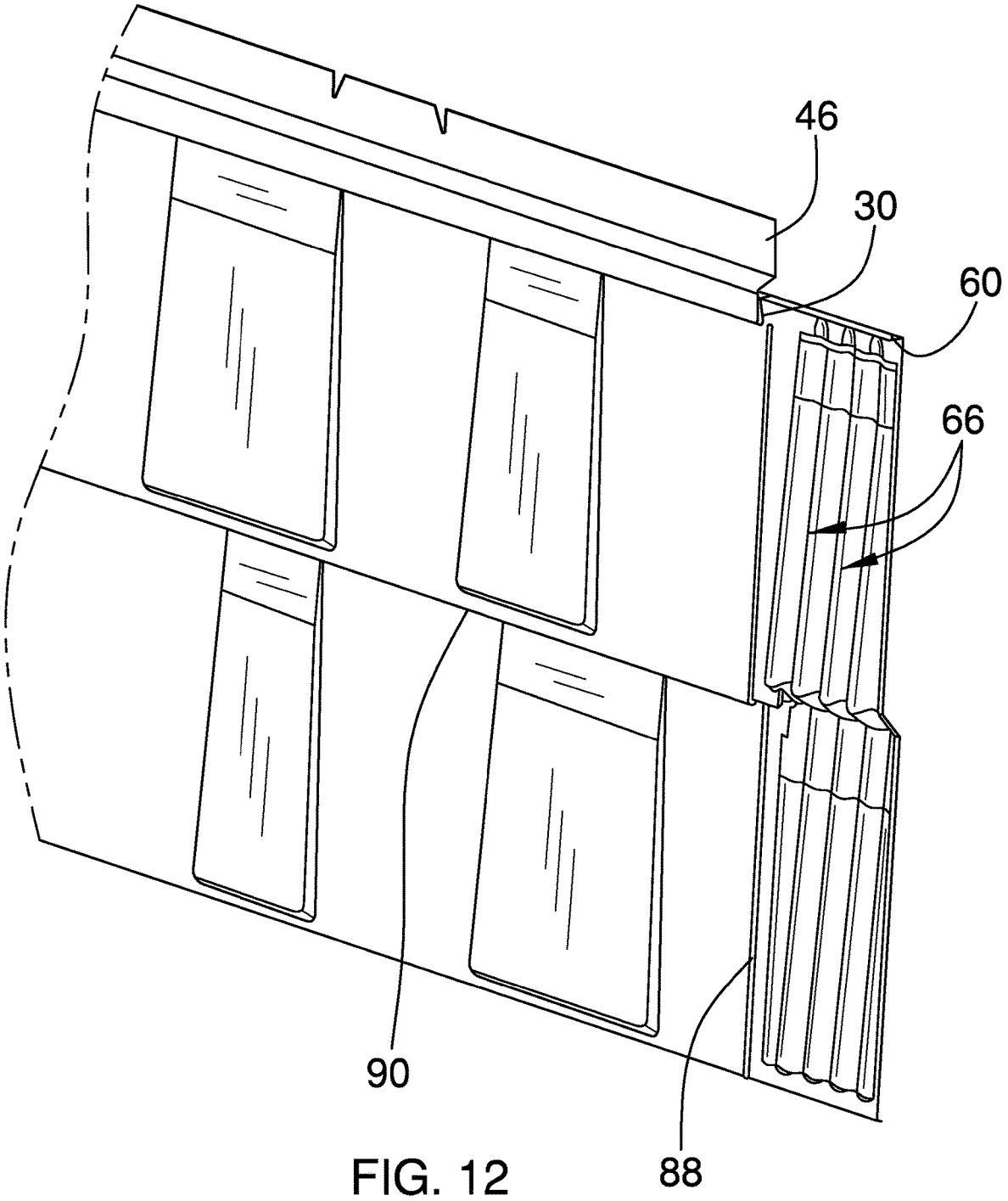
FIG. 12 is a front, top right isometric view of an embodiment of the disclosure.

As can be seen with particularity in FIG. 7, the rearward section 34 may be orientated perpendicular to the panel 12. The extension portion 36 may include an upward wall 42 orientated perpendicular to the rearward section 34 and a forward wall 44 extending toward the back side 16 such that the forward wall is orientated generally parallel to the rearward section 34. The forward wall 44 may include a terminal tab 45 running along its length that is angled toward the rearward section 34 to facilitate urging of the extension portion 36 under the downward portion 30. However, as with the upper coupler 26, the lower coupler 32 may also be arcuate or include arcuate sections.

A nailing strip 46 is attached to and extends upwardly from the upper coupler 26. The nailing strip 46 is configured to receive fasteners, such as nails or screws for example, that are extendable into a roof structure to secure the panel 12 to the roof structure. The nailing strip 46 may be attached to and extend upwardly of the downward portion 30 wherein the nailing strip 46 is attached to the outer end 40 of the downward portion 30, extends upwardly over the downward portion 40 and upwardly away from the panel 12. A gap 47 is formed between the upper coupler 26 and an upper portion of the nailing strip 46 as the nailing strip angles rearwardly and upwardly from the upper coupler 26.

A flange 48 is integrally attached to and extends along the second lateral edge 24 such that the flange 48 and the panel 12 form a unitary member, as stated above. The flange 48 extends laterally away from the panel 12 and has a front side 50, a back side 52, an upper edge 54, and a lower edge 56 corresponding to the front 14 and back 16 sides and the upper 18 and lower 20 edges of the panel 12. The flange 48 has a distal edge 58 with respect to the panel 12. The panel 12 and flange 48 may be provided any size though common sizes will generally include a width from the first lateral edge 22 to the distal edge 58 between 30.0 inches and 80.0 inches a height from the upper edge 18 to the lower edge 20 between 9.0 inches and 20.0 inches.

Figure 13:
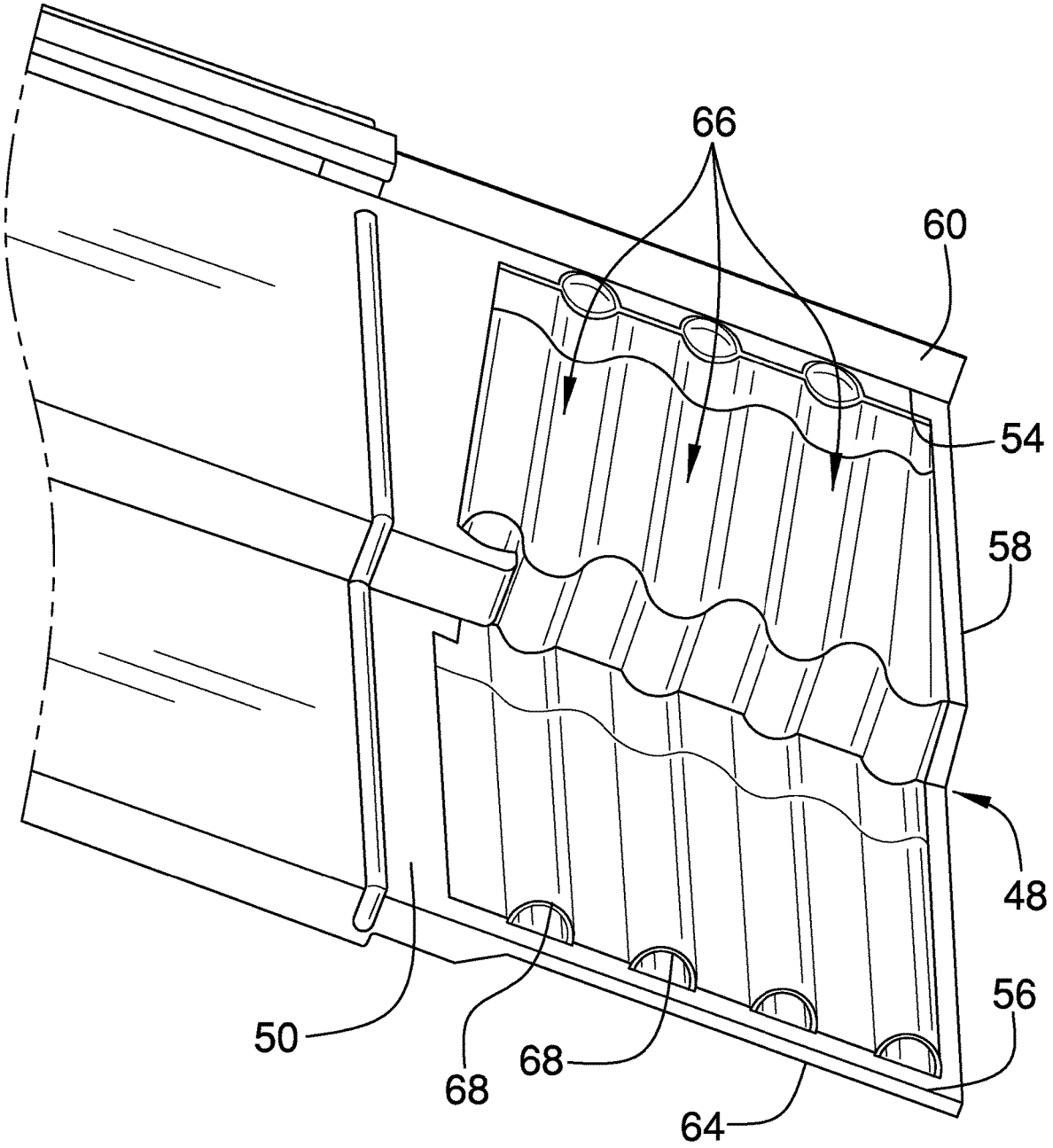
FIG. 13 is a front, bottom right isometric view of an embodiment of the disclosure.
Figure 14:
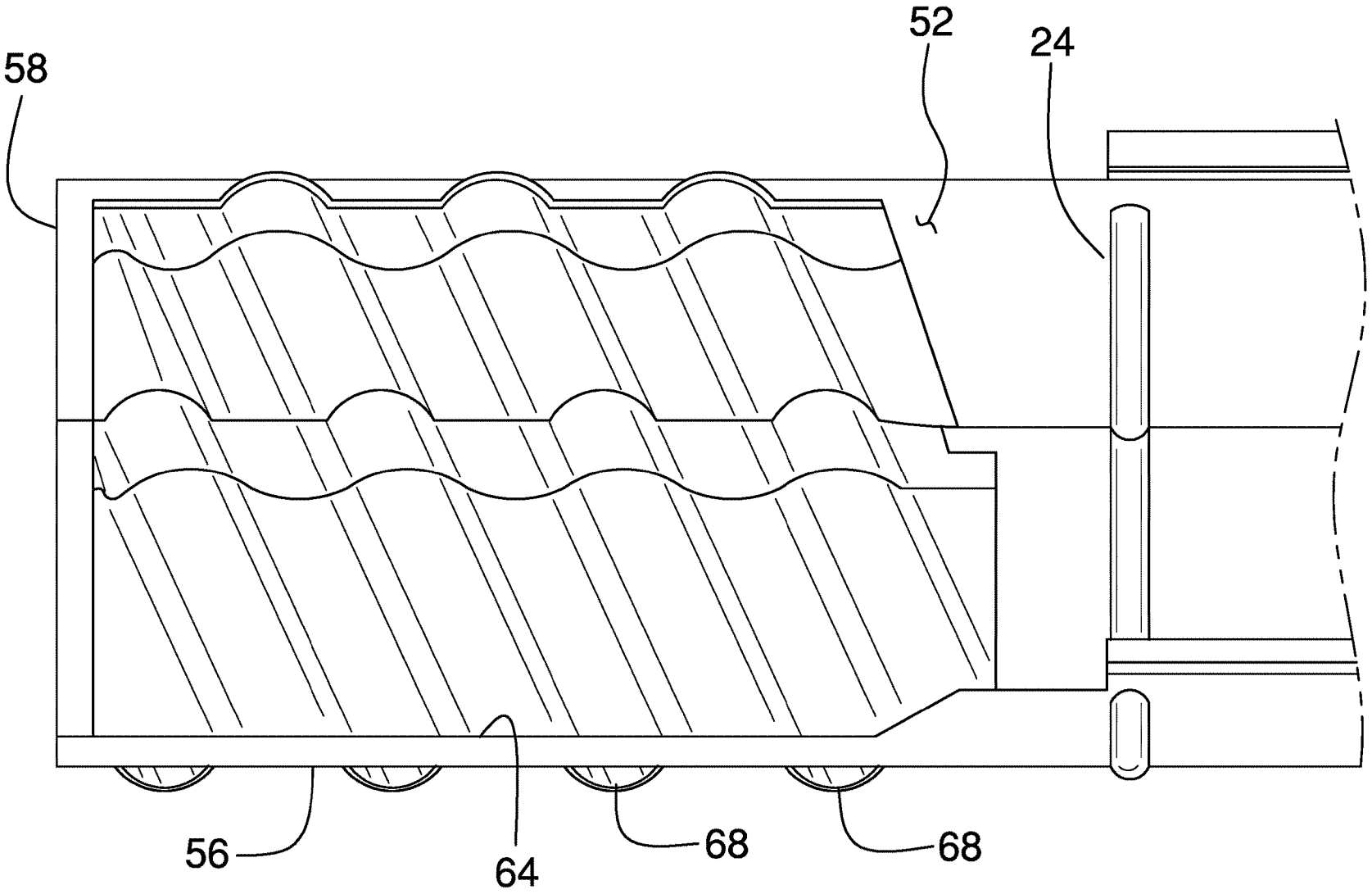
FIG. 14 is a bottom isometric view of an embodiment of the disclosure.

As depicted best in FIG. 13, a lip 60 is coextensive with and extends forwardly of the upper edge 54 of the flange 48. The lip 60 inhibits water from wicking upwardly beyond the upper edge 54 of the flange 48. The lip 60 is positionable the gap 47 and against an upper surface 62 of the upper coupler 26 of another one of the shingle assemblies 10 when the shingle assemblies 10 are positioned laterally adjacent to each other. A catch 64 is coextensive with and extends rearwardly of the lower edge 56 of the flange 48.

A channel 66 extends into the front side 50 of the flange 48 and is configured to direct water away from the upper edge 54 and toward the lower edge 56. The channel 66 is angled away from the distal 58 and upper 54 edges of the flange 48 and toward the second lateral 24 and lower 20 edges of the panel 12. As can be seen in the Figures, the channel 66 may comprise a plurality of channels 66 interspersed with raised areas 68.

The lower coupler 32 is spaced from the first lateral edge 22 such that a portion of the lower edge 20 does not include the lower coupler 32. A receiver 70 is attached to the lower edge 20 of the panel 12 from the lower coupler 32 to the first lateral edge 22. The receiver 70 is configured to receive the lower edge 56 of a flange 48 of another one of the shingle assemblies 10. The receiver 70 has an aperture 72 extending downwardly and rearwardly therethrough to facilitate fluid drainage outwardly therefrom. The receiver 70, as can be seen in the Figures, includes a bottom wall 74 extending rearward of the panel 12 and outer wall 76 extending upwardly from the bottom wall 74. The lower edge 56 of the flange 48 is positionable between the outer wall 76 and the panel 12.

The back side 16 of the panel 12 has a plurality of embossments 78 therein such that the embossments 78 form raised sections 80 in the front side 14 of the panel 12. The embossments 78 provide both aesthetic and functional features. Each of the raised sections 80 has a top edge 82, a bottom edge 84 and a pair of side edges 86. At least one of the embossments 78 is positioned to overlap the flange 48 of an adjacently positioned one of the shingle assemblies 10 to provide space for the raised areas 68 between channels 66 to prevent the raised areas 68 from abutting and lifting up an overlapped panel 12. Each of the embossments 78 has a trapezoidal shape wherein a length of the bottom edge 84 is greater than a length of a corresponding one of the top edges 82. This shape provides the aesthetic appearance of conventional asphalt shingles. A stop 88 extends upwardly from the panel 12 adjacent to the second lateral edge 24. The stop 88 is abuttable against a first lateral edge 22 of an adjacent one of the shingle assemblies 10 to facilitated lateral alignment of adjacent ones of the assemblies 10.

The assemblies 10 may include a shoulder 90 extending from the first lateral edge 22 to the distal edge 58 of the flange 48. When a shoulder 90 is utilized a top half 92 and a bottom half 94 of the assembly 10 is defined wherein each of the top 92 and bottom 94 halves include embossments 78. As can be seen in the Figures, embossments 78 are positioned on the top 92 and bottom 94 halves adjacent to the first lateral edge 22 to cover the channels 66/raised areas 68 in the top 92 and bottom 94 halves of the flange 48.

Figure 4:
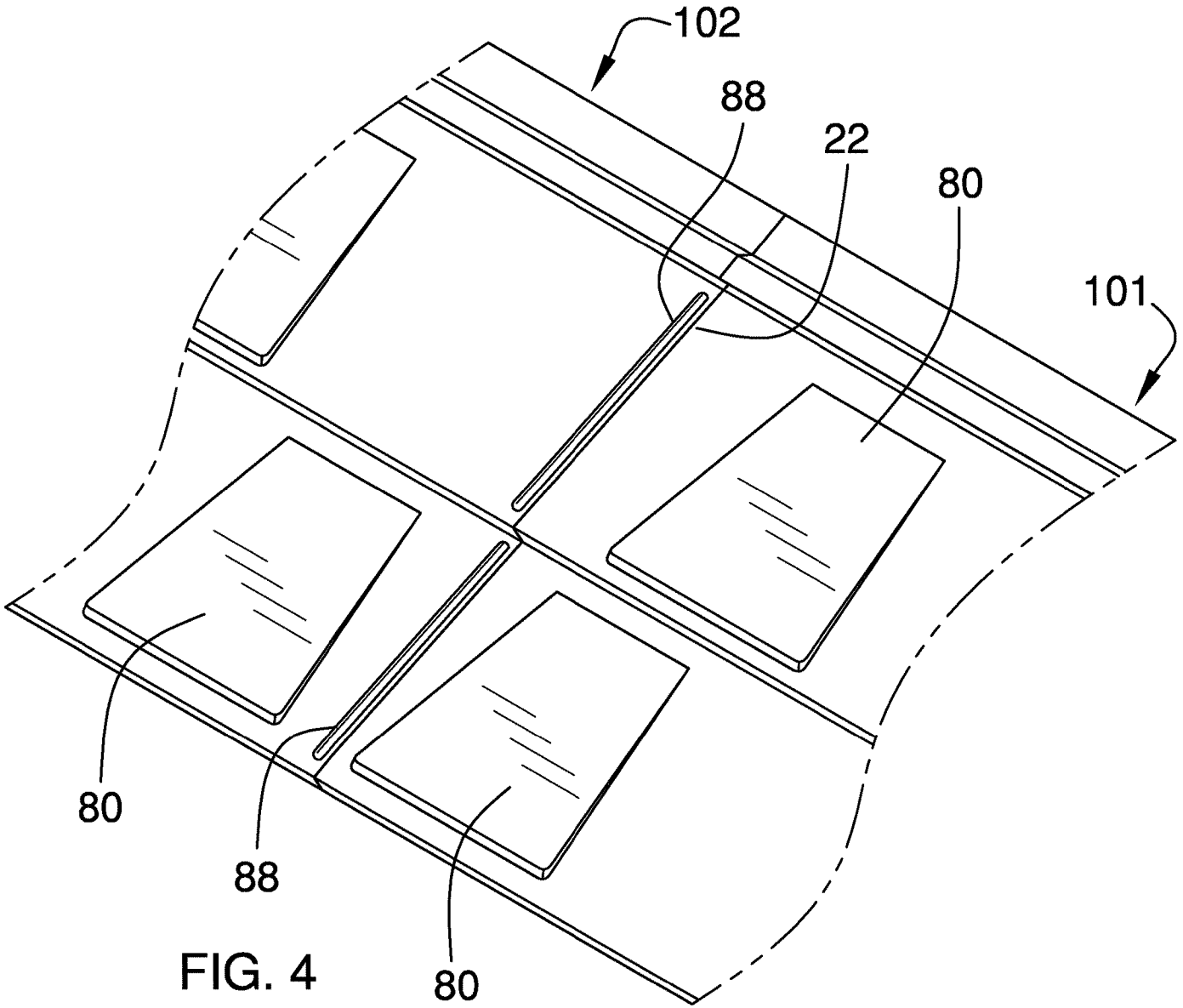
FIG. 4 is a front isometric view of an embodiment of the disclosure showing two shingle assemblies connected together laterally.
Figure 5:
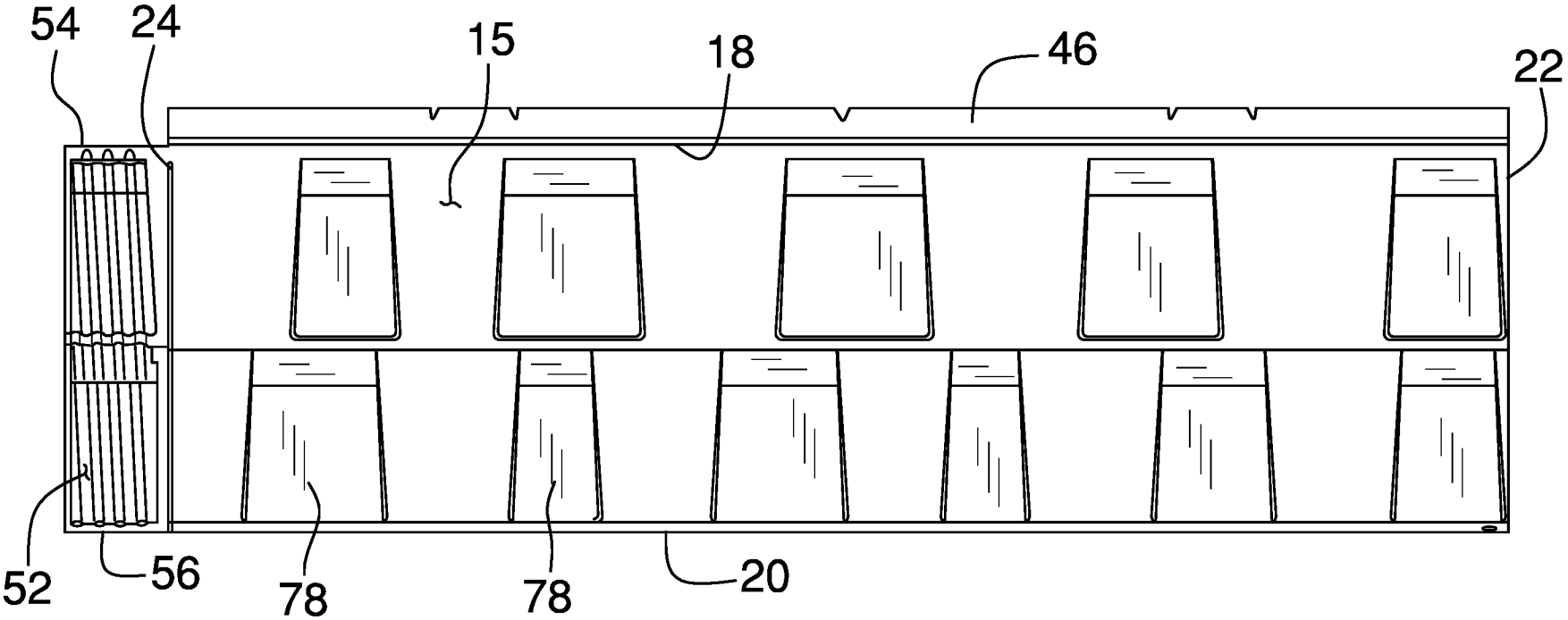
FIG. 5 is a rear view of an embodiment of the disclosure.
Figure 6:
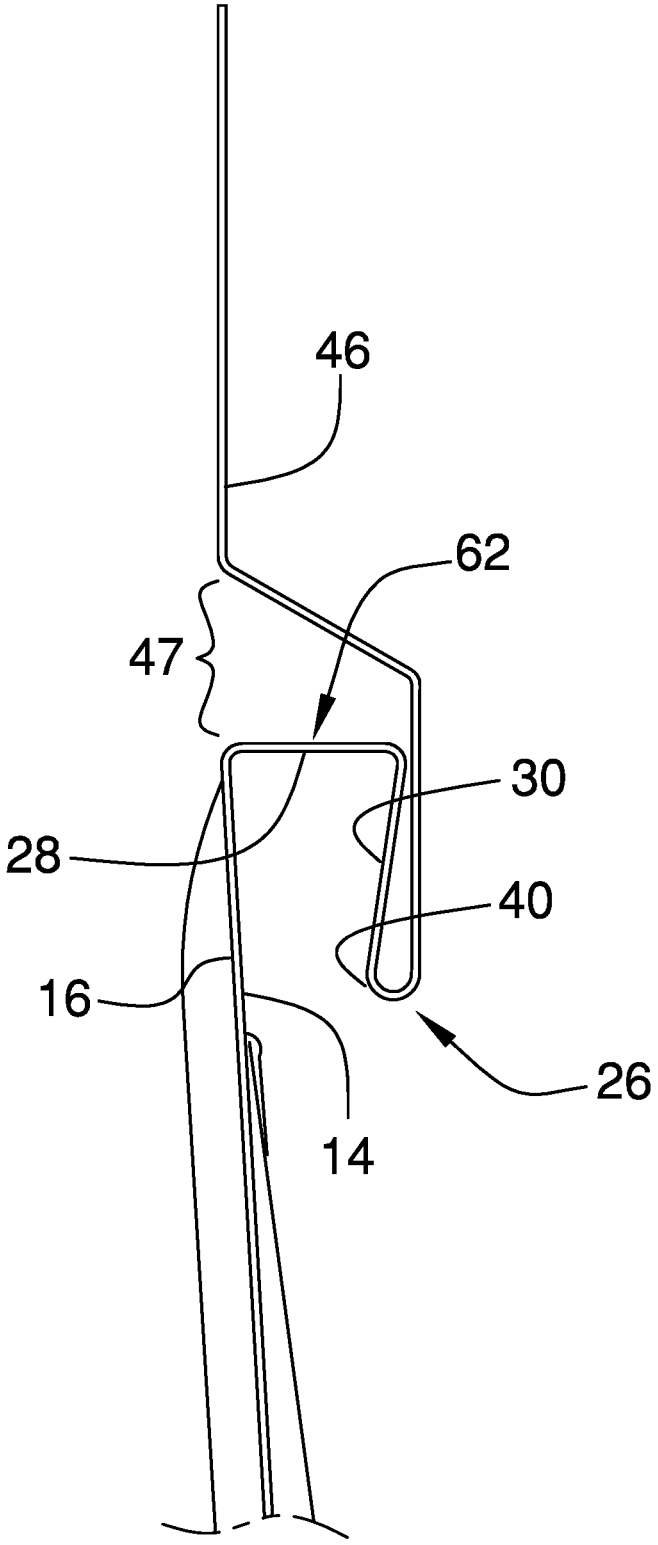
FIG. 6 is a broken side view of an upper coupler of an embodiment of the disclosure.

In use, the assemblies 10 are attached to a roof substructure in a conventional manner by driving fasteners through the nailing strip 46 and into the roof substructure. As they are positioned laterally (as shown in FIG. 4) on the roof substructure the back side 16 of a first assembly 101 is positioned on the front side 50 of the flange 48 of a second assembly 102 so that the first lateral edge 22 of the first assembly 101 is adjacent to the second lateral edge 24 of the second assembly 102. In this position, the lip 60 of the flange 48 is positioned in the gap 47 and abutted against the upper coupler 26 of the first assembly 101, and the lower edge 56 of the flange 48 is positioned in the receiver 70 of the first assembly 101.

Figure 3:
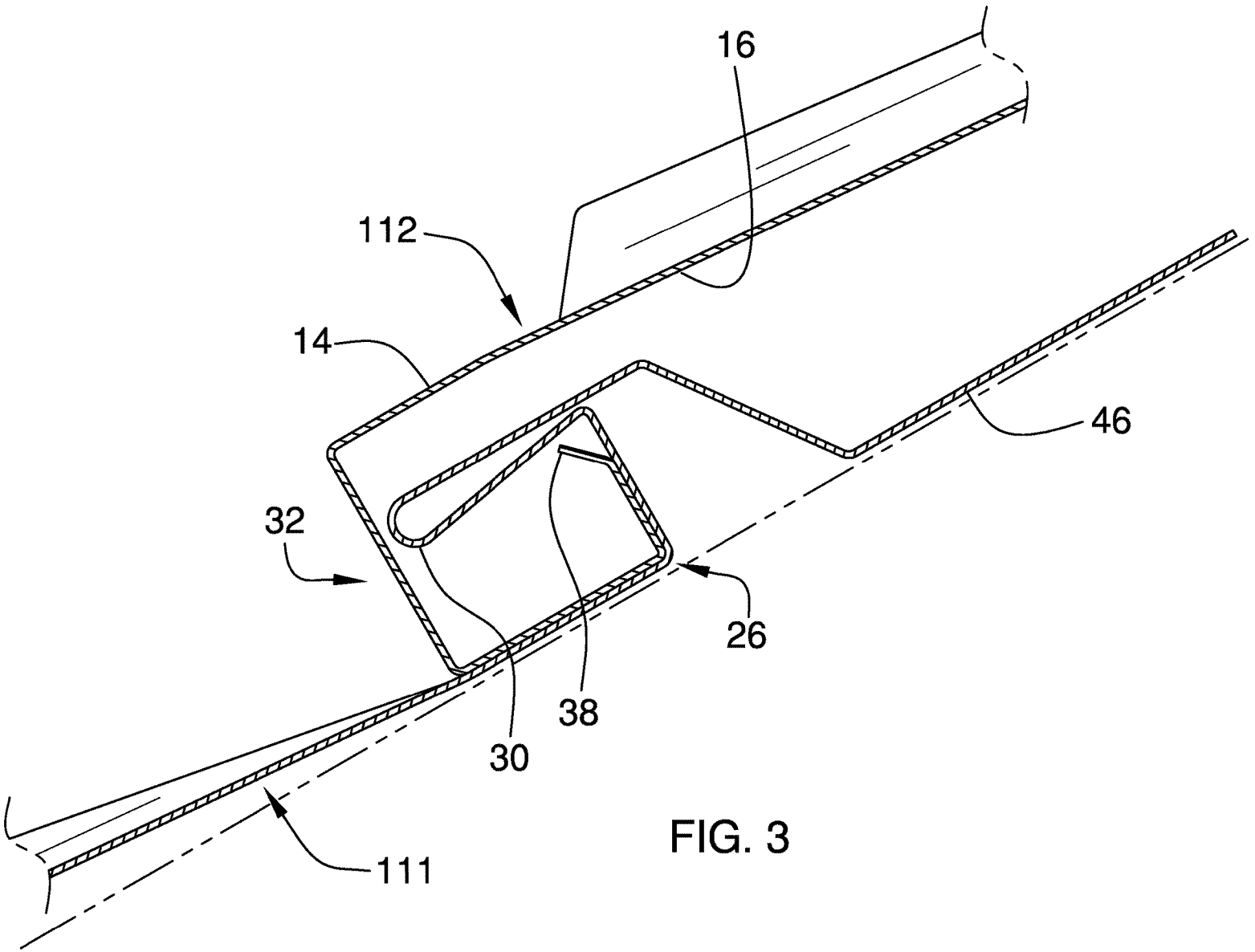
FIG. 3 is a cross-sectional view of an embodiment of the disclosure showing a connection between an upper coupler and a lower coupler of a pair of shingle assemblies vertically coupled together.

When a first assembly 111 and a second assembly 112 are positioned vertically as shown in FIG. 3, the first assembly 111 is attached to the roof substructure and the lower coupler 32 of the second assembly 112 is engaged with the upper coupler 26 of the first assembly 111. The lower coupler 32 is snapped into the upper coupler 26 to releasably retain the first 111 and second 112 assemblies together such that the second assembly 112 can be secured to the roof substructure. The lip 60 on the flange 48 of the first assembly 111 may be positioned behind and engage the male coupler 32 if the tiles are laterally offset with respect to each other.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A shingle assembly configured to be attachable to a roof structure for protection thereof and interlocked with adjacent shingle assemblies, the shingle assembly comprising:

a panel having a front side, a back side, an upper edge, a lower edge, a first lateral edge, and a second lateral edge;

an upper coupler being attached to and extending along the upper edge;

a lower coupler being attached to and extending along the lower edge, the lower coupler being configured to engage an upper coupler of another one of the shingle assemblies;

a flange being integrally attached to and extending along the second lateral edge such that the flange and the panel form a unitary member, the flange extending laterally away from the panel and having a front side, a back side, an upper edge, and a lower edge corresponding to the front and back sides and the upper and lower edges of the panel, the flange having a distal edge with respect to the panel; and a channel extending into the front side of the flange and being configured to direct water away from the upper edge and toward the lower edge, wherein the channel is angled away from the distal and upper edges of the flange and toward the second lateral and lower edges of the panel.

2. The shingle assembly according to claim 1, wherein the lower coupler is spaced from the first lateral edge, a receiver being attached to the lower edge of the panel from the lower coupler to the first lateral edge, the receiver being configured to receive the lower edge of a flange of another one of the shingle assemblies.

3. The shingle assembly according to claim 2, wherein the receiver has an aperture extending downwardly and rearwardly therethrough to facilitate fluid drainage outwardly therefrom.

4. The shingle assembly according to claim 1, wherein the back side of the panel has a plurality of embossments therein such that the embossments form raised sections in the front side of the panel, each of the raised sections having a top edge, a bottom edge and a pair of side edges, at least one of the embossments being positioned to overlap the flange of an adjacently positioned one of the shingle assemblies.

5. The shingle assembly according to claim 4, wherein each of the embossments has a trapezoidal shape wherein a length of the bottom edge is greater than a length of a corresponding one of the top edges.

6. A shingle assembly configured to be attachable to a roof structure for protection thereof and interlocked with adjacent shingle assemblies, the shingle assembly comprising:

a panel having a front side, a back side, an upper edge, a lower edge, a first lateral edge, and a second lateral edge;

an upper coupler being attached to and extending along the upper edge, the upper coupler including a forward portion abutting and extending forwardly from the upper edge and a downward portion extending from the forward portion and over the front side, the downward portion being angled rearwardly toward the front side;

a lower coupler being attached to and extending along the lower edge, the lower coupler being configured to snappily engage an upper coupler of another one of the shingle assemblies, the upper coupler comprising a female coupler and the lower coupler comprising a male coupler, the lower coupler including:

a rearward section abutting and extending rearwardly from the lower edge;

an extension portion being attached to the rearward section and extending upwardly and then forwardly with respect to the panel, the extension portion having a terminal end being spaced from the back side of the panel a distance greater than a distance between an outer end of the downward portion and the front side of the panel;

a nailing strip being attached to and extending upwardly from the upper coupler, wherein the nailing strip is configured to receive fasteners extendable into a roof structure to secure the panel to the roof structure;

a flange being integrally attached to and extending along the second lateral edge such that the flange and the panel form a unitary member, the flange extending laterally away from the panel and having a front side, a back side, an upper edge, and a lower edge corresponding to the front and back sides and the upper and lower edges of the panel, the flange having a distal edge with respect to the panel;

a lip being coextensive with and extending forwardly of the upper edge of the flange, the lip inhibiting water from wicking upwardly beyond the upper edge of the flange, the lip being abuttable against an upper surface of the upper coupler of another one of the roof assemblies; and a channel extending into the front side of the flange and being configured to direct water away from the upper edge and toward the lower edge, wherein the channel is angled away from the distal and upper edges of the flange and toward the second lateral and lower edges of the panel.

7. The shingle assembly according to claim 6, wherein:

the lower coupler being spaced from the first lateral edge, a receiver being attached to the lower edge of the panel from the lower coupler to the first lateral edge, the receiver being configured to receive the lower edge of a flange of another one of the shingle assemblies, the receiver having an aperture extending downwardly and rearwardly therethrough to facilitate fluid drainage outwardly therefrom; and the back side of the panel having a plurality of embossments therein such that the embossments form raised sections in the front side of the panel, each of the raised sections having a top edge, a bottom edge and a pair of side edges, at least one of the embossments being positioned to overlap the flange of an adjacently positioned one of the shingle assemblies.

* * * * *